US006524049B1

(12) United States Patent
Minnes

(10) Patent No.: US 6,524,049 B1
(45) Date of Patent: Feb. 25, 2003

(54) SEMI-SUBMERSIBLE, MOBILE DRILLING VESSEL WITH STORAGE SHAFT FOR TUBULAR DRILLING EQUIPMENT

(75) Inventor: Roelof Arnoldus Minnes, Tolkamer (NL)

(73) Assignee: Workships Contractors B.V., Rotterdam (NL)

( * ) Notice: Subject to any disclaimer, the term of this patent is extended or adjusted under 35 U.S.C. 154(b) by 0 days.

(21) Appl. No.: 09/445,726

(22) PCT Filed: Sep. 2, 1997

(86) PCT No.: PCT/NL97/00503

§ 371 (c)(1),
(2), (4) Date: Feb. 14, 2000

(87) PCT Pub. No.: WO98/56652

PCT Pub. Date: Dec. 17, 1998

(30) Foreign Application Priority Data

Jun. 11, 1997 (NL) ..... 1006287

(51) Int. Cl.[7] ..... E21B 19/14

(52) U.S. Cl. ..... 414/22.51; 414/22.63; 414/22.58; 414/745; 414/747; 114/265; 175/5

(58) Field of Search ..... 414/22.51, 22.63, 414/22, 745, 747, 22.58; 405/207, 210, 211; 175/52, 5; 211/70.4; 114/265

(56) References Cited

U.S. PATENT DOCUMENTS

| | | | | |
|---|---|---|---|---|
| 3,987,910 A | | 10/1976 | Brunato | |
| 4,044,895 A | | 8/1977 | Adair | |
| 4,091,760 A | * | 5/1978 | Lloyd, III | 114/264 |
| 4,114,392 A | * | 9/1978 | Lamy | 405/207 |
| 4,596,291 A | * | 6/1986 | Makinen et al. | 175/5 |
| 4,613,001 A | * | 9/1986 | Edberg | 175/52 |
| 4,692,081 A | | 9/1987 | Bennett et al. | |
| 4,708,563 A | * | 11/1987 | Van Den Berg et al. | 414/22 |
| 5,292,207 A | * | 3/1994 | Scott | 405/207 |
| 5,542,783 A | * | 8/1996 | Polluck | 405/223.1 |

FOREIGN PATENT DOCUMENTS

| | | |
|---|---|---|
| EP | 0273474 | 7/1988 |
| WO | 8503050 | 7/1985 |

OTHER PUBLICATIONS

Patent Abstracts of Japan, vol. 14, No. 395 (M–395), Aug. 27, 1990 & JP 02 147790 A (Ishikawajima Harima Heavy Industries Co Ltd.) Jun. 6, 1990.

G.J. Schepman: "Booreiland voor de jaren negentig", vol. 43, No. 11, Nov. 1988, pp. 38–42, XP000030108.

Patent Abstracts of Japan, vol. 7, No. 102 (M–211), Apr. 30, 1983 & JP 58 022785 A (Mitsubishi Jukogyo KK), Feb. 10, 1983.

* cited by examiner

*Primary Examiner*—Joseph A. Fischetti
(74) *Attorney, Agent, or Firm*—Bachman & LaPointe, P.C.

(57) ABSTRACT

The drilling vessel includes at least one floating body and a platform which is supported by one or more support columns on the floating body and includes a drilling installation. The vessel is provided with storage provisions for tubular drilling equipment. The storage provisions include one or more shafts which are disposed in one or more of the support columns, extend downwards from the platform and in which a number of items of the drilling equipment can be vertically disposed.

16 Claims, 3 Drawing Sheets

SEMI-SUBMERSIBLE, MOBILE DRILLING VESSEL WITH STORAGE SHAFT FOR TUBULAR DRILLING EQUIPMENT

BACKGROUND OF THE INVENTION

The invention relates to a semi-submersible drilling vessel, comprising at least one floating body and a platform which is supported via one or more columns on the at least one floating body and has a drilling installation, the vessel being provided with storage means for tubular drilling equipment, such as risers, drill pipes, casings, liners, etc.

A semi-submersible, mobile drilling vessel of this kind is generally known. Such a drilling vessel generally comprises two floating bodies, which are disposed parallel to one another with a space between them and are each provided with two or more columns on which the platform is supported. A drilling installation is then disposed on this platform, generally centrally. This platform is furthermore provided with accommodation for the crew, working areas and storage areas/storage means for the drilling equipment, such as tubular drilling equipment in the form of risers, drill pipes, casings, liners, etc. Semi-submersible, mobile drilling vessels of this kind were originally designed for use in relatively shallow waters down to depths of approximately 300 meters, such as for example the North Sea. The drilling vessel can be transported to its intended destination as a type of catamaran with the floating bodies in the floating position, and on reaching this destination the floating bodies are filled with ballast, generally water, in order to sink below the water level so as to improve the performance of the drilling vessel in heavy seas, in particular with regard to its resistance to the swell. For drilling depths of up to approximately 300 meters, there is sufficient space available on the so-called main deck of the drilling platform to store all the tubular drilling equipment, in particular the risers, drill pipes, casings and liners. If a semi-submersible, mobile drilling vessel of this kind is to be used in deeper waters, correspondingly more risers are also required. For waters of depths of up to about 800 meters, it is generally possible to create sufficient space on deck for the extra risers and other tubular drilling equipment required. However, a drawback of this is that the stability of the drilling vessel as a whole is reduced owing to the relatively great weight stored on the main deck. However, the stability remains sufficient, as does the stability in the semi-submerged state, which is very important for such installations in practice, in connection with the greater weight of these risers. However, the conventional semi-submersible, mainly small drilling vessels are unable to transport sufficient drilling equipment for depths of greater than about 800 meters. This problem can be overcome by accompanying mobile drilling vessels of this kind by an extra cargo vessel, on which the heavy drilling equipment is stored. The associated disadvantages are clear. Another possibility is to employ a much larger, and therefore more expensive, semi-submersible, mobile drilling vessel.

SUMMARY OF THE INVENTION

This object is achieved according to the invention in that the storage means comprise one or more shafts which are disposed in one or more of the said support columns, extend downwards from the platform and in which a number of items of the said drilling equipment can be vertically disposed. Accommodating the elongate, tubular drilling equipment in the columns creates extra loading space, and moreover, certainly if the relatively heavy tubular drilling equipment is stored in the columns, the center of gravity of the load moves to a lower position, which is very advantageous for the stability of the drilling vessel. By means of a hoisting installation which is generally already present on a semi-submersible, mobile drilling vessel of this kind, or an optionally specially adapted hoisting installation, the tubular drilling equipment stored in the shaft or shafts can then be lifted out of the shaft in the vertical direction, can be placed, oriented in the horizontal direction, on the conventional handling device to be supplied to the drilling installation, disposed in the drilling installation and added to the drill string by the drilling installation.

In order to prevent movement of the load in the shafts and to permit optimum filling of the shafts, it is advantageous according to the invention if the shaft or if appropriate each shaft is provided with a guide system, such as a rack, for holding the tubular drilling equipment disposed in the said shaft vertically and at a fixed location (with regard to the horizontal plane). A guide system of this kind may, for example, comprise one, two or more grate-like, horizontally disposed racks, each grate opening being suitable to allow through an item of tubular drilling equipment to be disposed in the shaft.

In order to facilitate lifting tubular drilling equipment out of the shaft and placing them therein, it is advantageous according to the invention if the shaft is open (completely open) or at least can be opened (can be completely opened) from above. The tubular drilling equipment can then be unloaded from the shaft without first having to be moved in the shaft into a specific removal position. This is because the tubular drilling equipment can then be lifted directly upwards in the vertical direction out of the shaft. Conversely, they can also be put directly in their position by lowering them vertically into the shaft.

In order to keep the tubular drilling equipment relatively easily accessible for the purpose of unloading from or loading into the shaft, it is advantageous if the shaft, measured from the main deck of the platform, has a depth which is essentially less than the length of the tubular drilling equipment to be disposed therein, so that this tubular drilling equipment projects above the main deck in the position in which it is disposed in the shaft. In this way, the top ends of the tubular drilling equipment are made relatively easily accessible for attaching and fitting handling means for loading and unloading the tubular drilling equipment. A further advantage is that it is possible in this way to store tubular drilling equipment in the shaft which has a length which is greater than the height of the column in which the shaft is incorporated. The tubular drilling equipment to be accommodated in the shaft can then, as it were, be as long as desired, except for the fact that an excessive length will have an adverse effect on the stability of the drilling vessel as a whole.

In order to prevent damage to the tubular drilling equipment disposed in the shaft, it is advantageous, when this tubular drilling equipment projects above the main deck, if a protective means is provided on the main deck around the shaft opening, such as railings or a bumper system, so that the ends, which project above the main deck, of the tubular drilling equipment disposed on the shaft are protected against mechanical impacts from the outside, such as collisions. Damage from, for example, vehicles travelling back and forth across the main deck or components of a hoisting installation can be prevented in this way.

In order, in the event of calamities, in particular a leak in a column or floating body, to be able to ensure the stability of the drilling vessel, it is advantageous according to the invention if the shaft is water-tight from the bottom up to at least the so-called freeboard deck. In this way, the shaft is prevented from filling up with water from the bottom, which could then spread across decks situated below the freeboard deck, which would be disastrous.

In order to be able to inspect the bottom ends of tubular drilling equipment disposed in the shaft, it is advantageous according to the invention if the bottom end of the shaft is accessible to people. In order for this accessibility not to impair the water-tightness of the shaft, it is advantageous here according to the invention if this accessibility is provided by means of a staircase arranged in the shaft or a lift installation arranged in the shaft. Also, this staircase or this lift installation is then protected from water below the freeboard deck by means of the water-tight shaft, thus saving on the need for doors which can be closed in a water-tight manner at the bottom end of the shaft. According to a further advantageous embodiment it is particularly advantageous with regard to the stability of the drilling vessel if the shaft and any guide system arranged therein are suitable for accommodating risers, which are generally the heaviest of the items of tubular drilling equipment.

According to a further advantageous embodiment, the drilling vessel will comprise two floating bodies which are disposed parallel to one another and with a space between them, and at least two columns will be provided per floating body. For each floating body, these columns will preferably all be disposed at essentially the same position with regard to the alongship or athwartship direction. With regard to the stability of the drilling vessel, it will then be advantageous if columns, which are in each case disposed at the same position in pairs, of different floating bodies are each provided with the same storage capacity for tubular drilling equipment, since in this way the weight is always evenly distributed over the sides of the drilling vessel.

BRIEF DESCRIPTION OF THE DRAWINGS

The present invention will be explained in more detail below with reference to an exemplary embodiment which is given only by way of example and is shown diagrammatically in the drawings, in which.

DETAILED DESCRIPTION OF PREFERRED EMBODIMENTS

Figure 1:
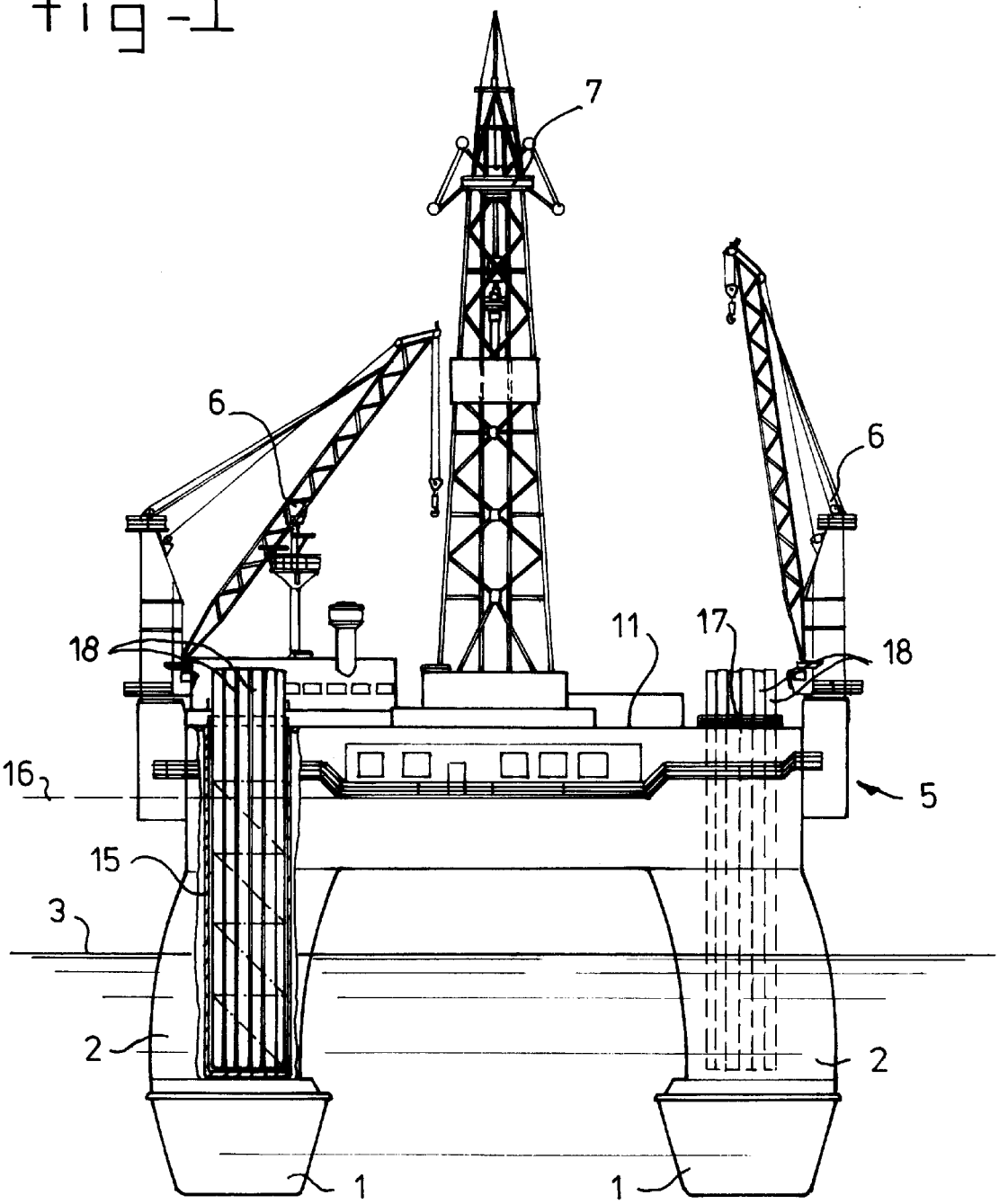
FIG. 1 shows a rear view, partially in section, of a semi-submersible, mobile drilling vessel according to the invention.

The semi-submersible, mobile drilling vessel in accordance with the drawing comprises two floating bodies 1, which are disposed parallel to and at a distance from one another and are each provided with two columns, namely a rear column 2 and a front column 4. With regard to the alongship direction, the columns are arranged in pairs at the same position on the adjoining floating bodies, i.e. the rear columns 2 are situated next to each other and the front columns 4 are situated next to each other. It will furthermore be clear that it is also possible, if desired, to provide even more columns per floating body and/or for more floating bodies to be provided, each with one or more columns. At some distance above the floating bodies, the columns support a platform 5. As diagrammatically illustrated, this platform 5 is provided with two hoisting or crane installations 6, a centrally positioned drilling installation 7, crew accommodation and working areas 8, a helicopter platform 9 and a number of lifeboats 10. Furthermore, a number of storage locations for drilling equipment are provided on the main deck 11 of the platform 5, at the rear of this main deck 11, which storage locations 12 are indicated very diagrammatically by rectangles provided with a cross. These storage locations are intended, inter alia, for storing drill collars, risers, liners, casings, drill pipes, finishing tools, auxiliary tools, etc. With the aid of the hoisting/crane installations 6, this drilling equipment, such as the tubular drilling equipment can be supplied to the drilling installation 7 or can be placed on a handling device (not shown but of conventional nature) which is suitable for supplying them to the drilling installation 7.

Figure 2:
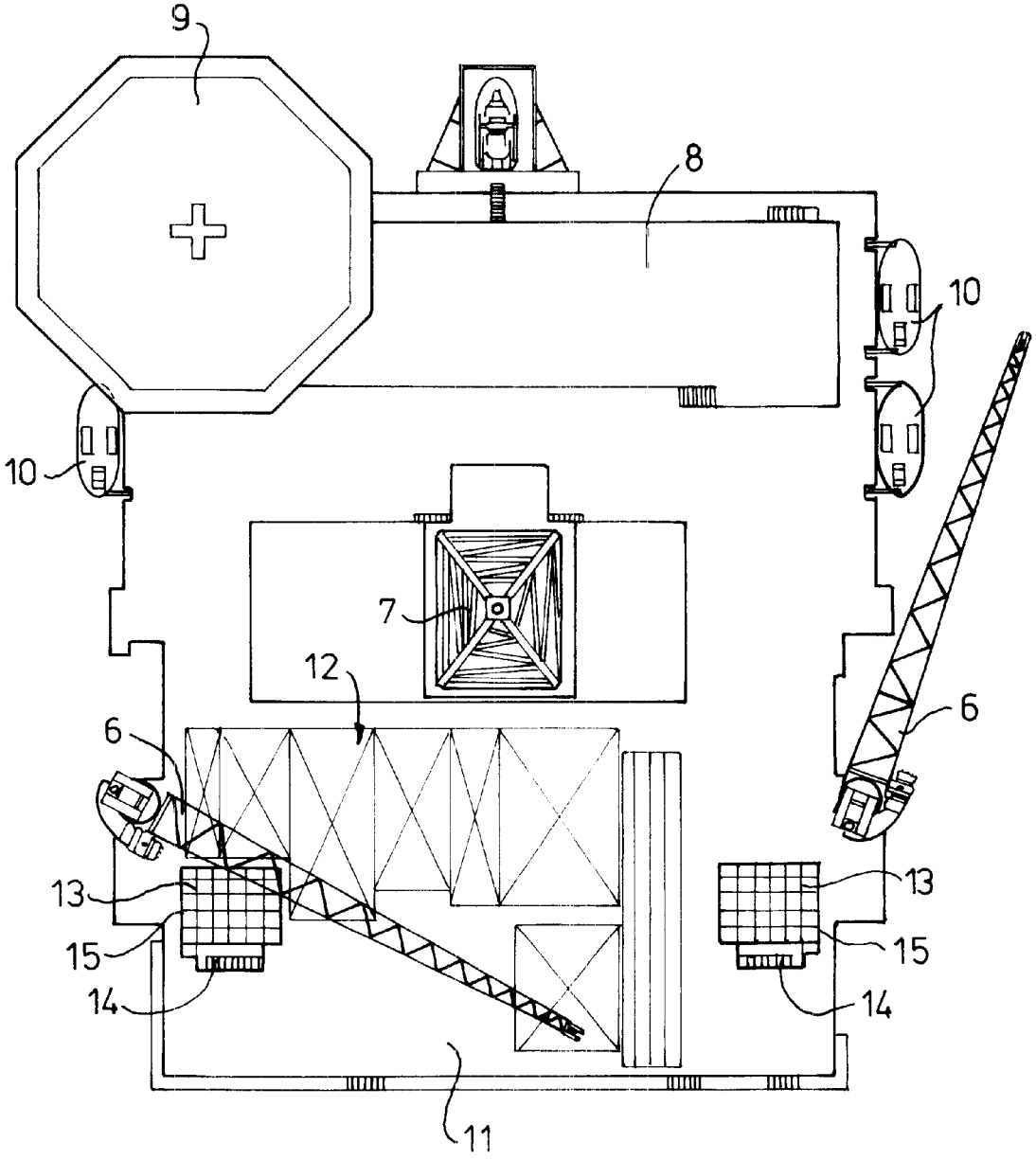
FIG. 2 shows a top view of the drilling vessel in accordance with FIG. 1.
Figure 3:
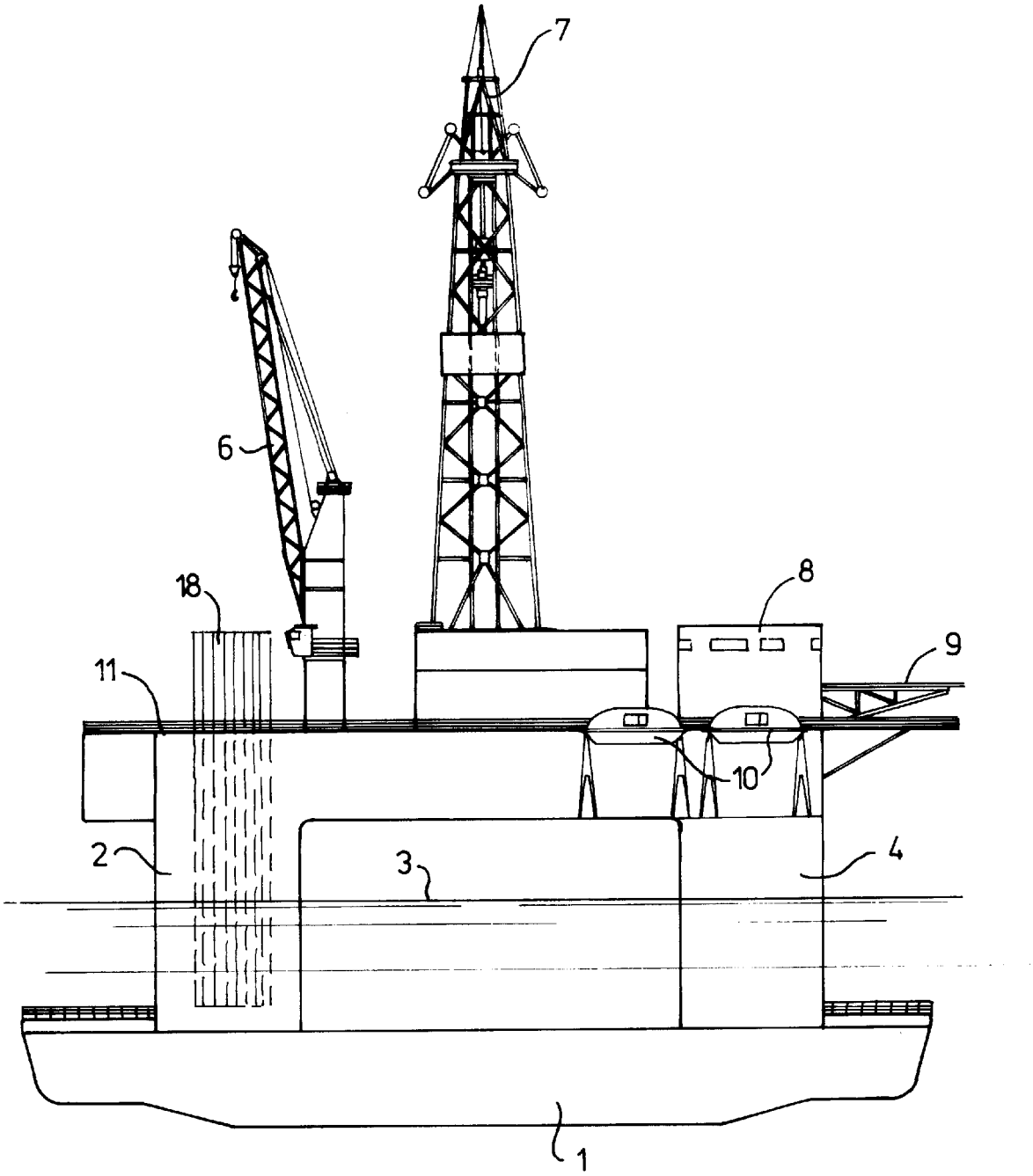
FIG. 3 shows an even more diagrammatic view along the longitudinal side of the drilling vessel in accordance with FIGS. 1 and 2.

According to the invention, the rear columns 2 are each provided with a shaft for storing relatively heavy (approximately 15 tons) risers having a length of about 65 feet (about 20 meters). As can be seen in particular in FIG. 2, each shaft is provided with a guide system, comprising a grate-like rack 13, in which thirty risers are positioned (6×5 grate sections). Furthermore, it can be seen in particular in FIG. 2 that each shaft 15 is provided with a staircase 14, which extends from the main deck 11 downwards into the shaft 15. People can descend via this staircase 14 from the main deck 11 to the bottom of the shaft 15, in order to be able here to inspect the bottom ends of risers disposed in the shaft.

The so-called freeboard height of the drilling vessel is indicated in FIG. 1 by means of a dashed line 16. With a view to the stability of the drilling vessel in the event of calamites, it is advantageous according to the invention if the shaft 15 is of water-tight design from the bottom up to at least the freeboard height 16 or the freeboard deck 16.

In FIG. 1, 17 indicates railings 17 arranged around the opening of the shaft in the main deck 11. The object of these railings is to prevent vehicles travelling over the main deck 11 from driving into the risers projecting upwards from the main deck 11 and damaging them. Railings 17 of this kind also effectively prevent other mechanical damage.

By means of the crane installations 6, the risers 18 can be lifted out of the shaft 15 one by one or optionally several at a time and can be placed on a conventional handling device (not shown) in order to be supplied in the horizontal position to the drilling installation 7 and to be pulled up by the drilling installation 7 into a vertical position. This moving of the riser into a vertical position by means of facilities arranged in the drilling installation 7 is known per se from the prior art.

The mobile drilling vessel illustrated in the figures is shown in the semi-submerged state, but it will be clear that by removing ballast from the floating bodies 1 by means of pump installations these floating bodies come to lie at the water level 3.

It will be clear that a large number of variants to the drilling vessel according to the invention are conceivable. For example, it is possible also to provide the front columns 4 with shafts for storing tubular drilling equipment. It is also conceivable to provide one or more columns with more than one shaft for storing tubular drilling equipment.

What is claimed is:

1. Semi-submersible, mobile drilling vessel, comprising at least two floating bodies and a platform which is supported by at least one support column on each of the at least two floating bodies and includes a drilling installation, the vessel being provided with storage means for tubular drilling equipment, wherein the storage means comprise at least one shaft disposed in at least one of the said support columns, which at least one shaft extends downwards from the platform and is configured for vertical disposition therein of a number of items of the said drilling equipment, wherein said support columns define an outer perimeter of said vessel, and wherein said shafts lie vertically above said floating bodies.

2. Drilling vessel according to claim 1, wherein the tubular drilling equipment comprises at least one of risers, drill pipes, casings and liners.

3. Drilling vessel according to claim 1, wherein said shaft is provided with a guide system for holding the tubular drilling equipment disposed in the shaft vertically and at a fixed position.

4. Drilling vessel according to claim 3, wherein the guide system includes a rack.

5. Drilling vessel according to claim 1, wherein the shaft is open.

6. Drilling vessel according to claim 1, wherein the shaft can be accessed from above.

7. Drilling vessel according to claim 1, wherein the platform includes a main deck, and wherein the shaft, measured from the main deck of the platform, has a depth which is less than the length of the tubular drilling equipment to be disposed therein, so that said tubular drilling equipment projects above the main deck in the position in which it is disposed in the shaft.

8. Drilling vessel according to claim 7, wherein the shaft includes an opening, wherein a protective means is provided on the main deck around the shaft opening, so that the ends of the tubular drilling equipment disposed in the shaft which ends project above the main deck are protected against impact.

9. Drilling vessel according to claim 8, wherein the protective means includes at least one of railings and a bumper system.

10. Drilling vessel according to claim 1, wherein the platform includes a freeboard height, and wherein the shaft is water-tight from the bottom thereof up to at least the freeboard height.

11. Drilling vessel according to claim 10, wherein the bottom end of the shaft is accessible to people, through access means.

12. Drilling vessel according to claim 11, wherein said access means includes a staircase, and wherein the bottom end of the shaft is accessible to people by said staircase arranged in the shaft.

13. Drilling vessel according to claim 1, wherein said shaft is configured for accommodating risers.

14. Drilling vessel according to claim 1, wherein the shaft includes a guide system arranged therein.

15. Drilling vessel according to claim 14, wherein the guide system is configured for accommodating risers.

16. Drilling vessel according to claim 1, wherein the drilling vessel comprises two floating bodies which are disposed parallel to one another and with a space therebetween, and wherein at least two support columns are provided per floating body.

* * * * *